US006832951B2

(12) United States Patent
Orendorff

(10) Patent No.: US 6,832,951 B2
(45) Date of Patent: Dec. 21, 2004

(54) VENT ASSEMBLY AND METHOD

(75) Inventor: Gary R. Orendorff, Beaverton, OR (US)

(73) Assignee: Classic Manufacturing NW, LLC, Wilsonville, OR (US)

( * ) Notice: Subject to any disclaimer, the term of this patent is extended or adjusted under 35 U.S.C. 154(b) by 0 days.

(21) Appl. No.: 10/154,949

(22) Filed: May 23, 2002

(65) Prior Publication Data

US 2003/0220068 A1 Nov. 27, 2003

(51) Int. Cl.[7] ..... F24F 13/075
(52) U.S. Cl. ..... 454/290; 454/324; 454/334
(58) Field of Search ..... 454/290, 299, 454/324, 274, 213, 334

(56) References Cited

U.S. PATENT DOCUMENTS

| | | | | |
|---|---|---|---|---|
| 1,788,721 A | | 1/1931 | Klomparens | |
| 2,930,309 A | | 3/1960 | Prager | |
| 3,236,171 A | | 2/1966 | Vaskov et al. | |
| 3,509,812 A | | 5/1970 | James | |
| 3,528,359 A | * | 9/1970 | Sand | 454/324 |
| 3,589,265 A | | 6/1971 | Hedrick | |
| 3,938,430 A | | 2/1976 | Koppang | |
| 3,955,483 A | | 5/1976 | Sunter | |
| 3,955,591 A | | 5/1976 | Baumann | |
| 4,319,520 A | * | 3/1982 | Lanting et al. | 454/290 |
| 4,394,958 A | | 7/1983 | Whitney et al. | |
| 4,417,687 A | | 11/1983 | Grant | |
| 4,907,500 A | | 3/1990 | Brown | |
| 5,052,440 A | | 10/1991 | Frank et al. | |
| 5,163,871 A | | 11/1992 | Huibregtse et al. | |
| 5,472,380 A | | 12/1995 | Sarazen, Jr. et al. | |
| 6,227,962 B1 | | 5/2001 | Orendorff | |
| 6,422,935 B1 | * | 7/2002 | Yampolski | 454/289 |

FOREIGN PATENT DOCUMENTS

| | | | | |
|---|---|---|---|---|
| FR | 730.634 | * | 8/1932 | 454/324 |
| FR | 730.634 | * | 10/1932 | 454/324 |
| FR | 2478252 | | 9/1981 | |
| GB | 1 349 450 | * | 4/1974 | 454/324 |
| GB | 1436555 | | 5/1976 | |
| GB | 2 001 413 | | 1/1979 | |
| IT | 488694 | | 12/1953 | |

OTHER PUBLICATIONS

Specification sheet entitled "Evaporative Diffuser" by Shoemaker, dated prior to filing of application.

* cited by examiner

*Primary Examiner*—Harold Joyce
(74) *Attorney, Agent, or Firm*—Klarquist Sparkman LLP

(57) ABSTRACT

A vent assembly has a vent cover and sliding air flow regulator for controlling the flow of air through the vent cover. Unique couplers may be used to interconnect the air flow regulator and vent cover for relative sliding motion. In addition, actuator mechanisms are used to move the air flow regulator between open and closed positions. A vent assembly for corner applications is also disclosed.

42 Claims, 9 Drawing Sheets

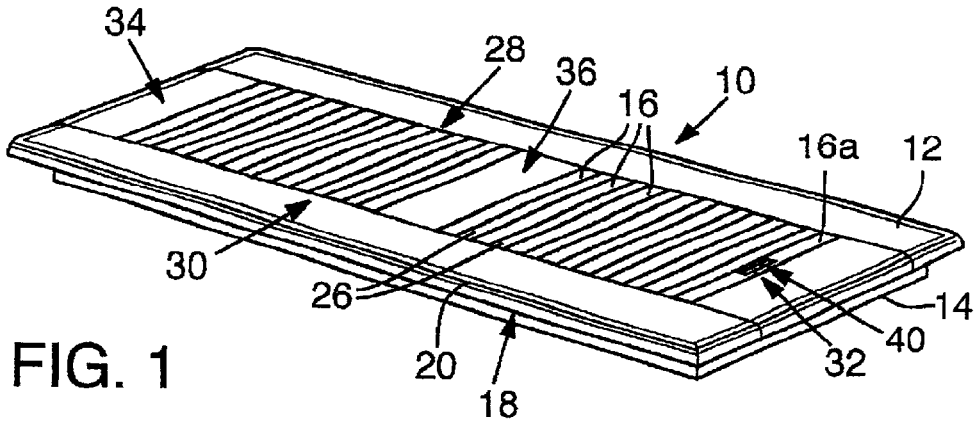
FIG. 1
FIG. 2
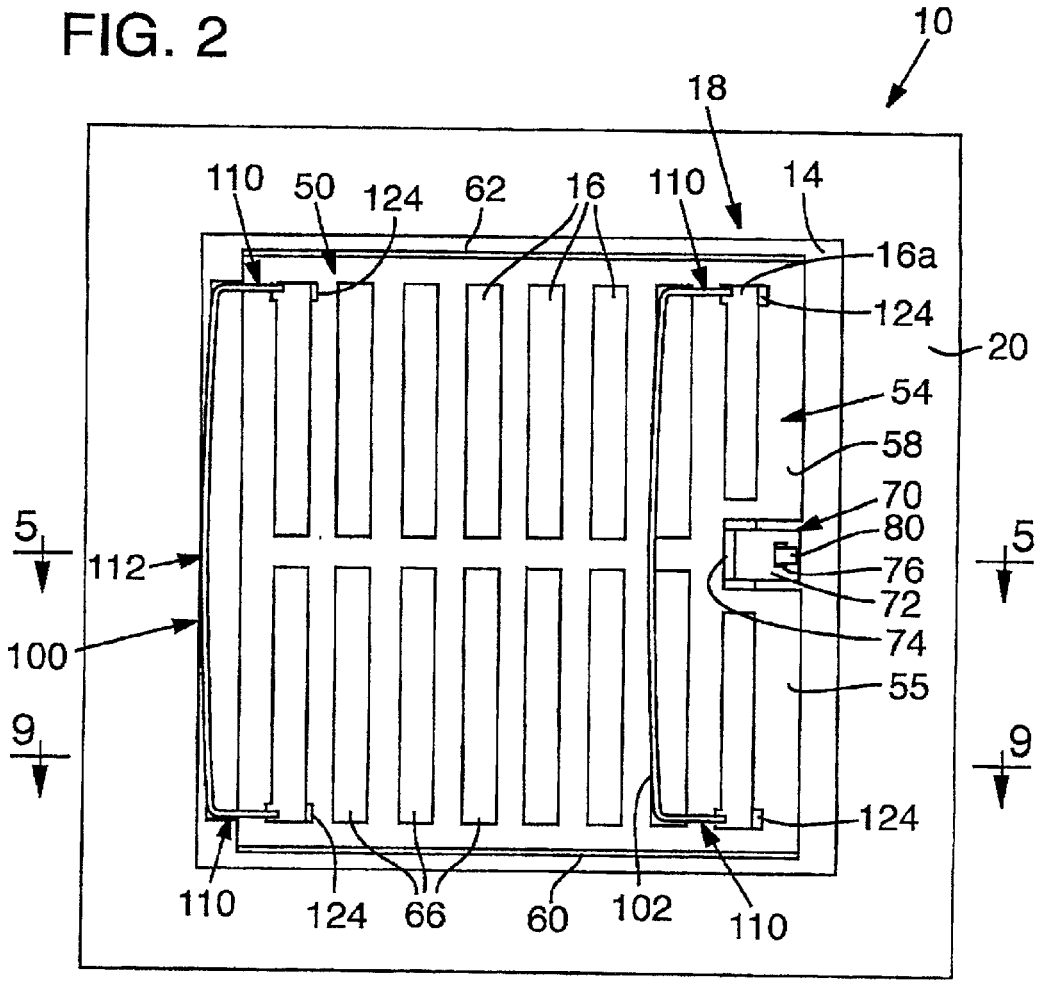

FIG. 5
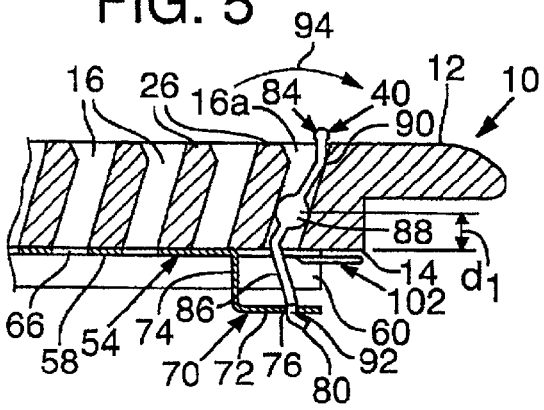
FIG. 6
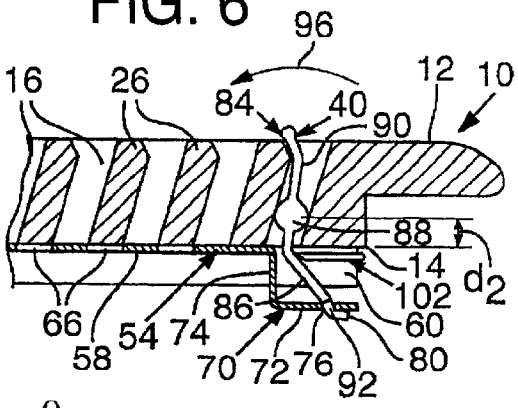
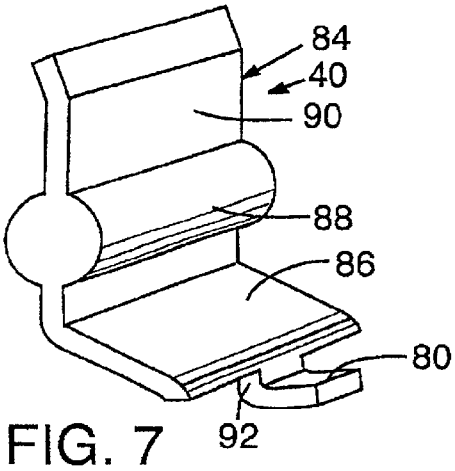
FIG. 7
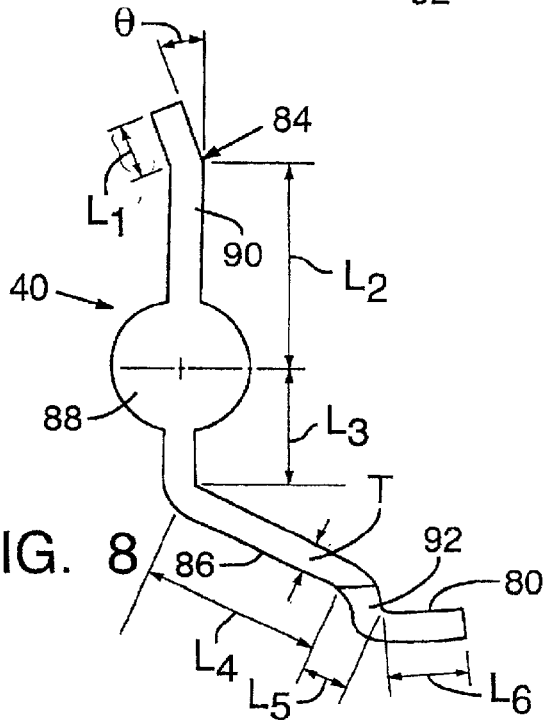
FIG. 8
FIG. 9
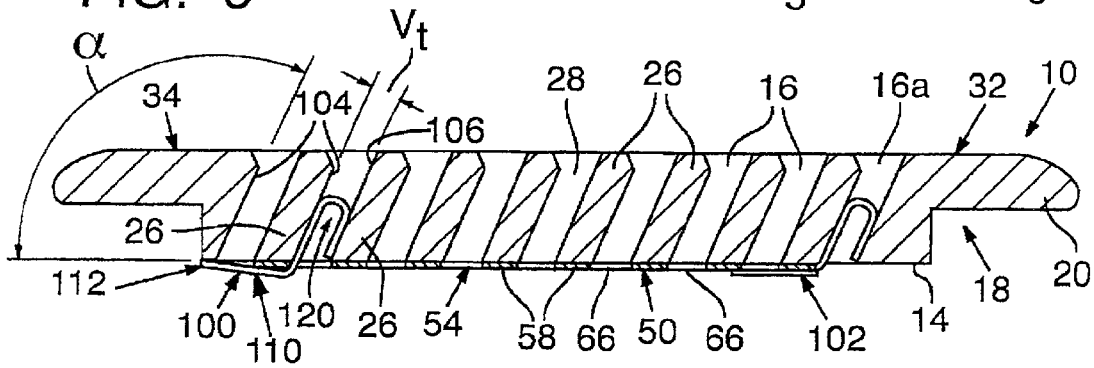

VENT ASSEMBLY AND METHOD

The present invention relates to a vent assembly having an air flow regulator slidable relative to a vent cover to control the flow of air through the vent cover. The invention also relates to methods relating to such a vent assembly.

BACKGROUND

Vent assemblies with a cover and a sliding air flow regulator or grill of various constructions are known. For example, U.S. Pat. No. 5,472,380 to Sarazen, Jr. et al. is understood to illustrate a construction in which a register or vent cover slidably receives a slide grill. The register defines a groove between the underside of vanes of the register and the upper surface of ridges formed in opposed sidewalls of the register. A handle, or tab, which can be integrally formed as part of the slide grill, extends upwardly in the space between two vanes of the cover so that it can be used to slide the grill.

U.S. Pat. No. 2,930,309 to Prager is understood to disclose an adjustable ventilator which has a vaned louver plate on one surface of a wall. A slidable plate assembly is located at the opposite side of the wall. The slidable plate assembly includes a cover having a plurality of openings which overlies a slide plate. Handles extend through slots in the cover and are used to slide the slide plate to selectively block or open the openings through the cover.

U.S. Pat. No. 3,509,812 to James is understood to illustrate a construction of a ventilator having an apertured back member fixed to a supporting surface and a front apertured member which is slidably mounted to the back member.

Although constructions of this type are known, a need exists for an improved vent assembly and method.

SUMMARY

The present invention is directed toward new and unobvious aspects of a vent assembly and method alone and in various combinations and subcombinations with one another. The invention is not limited to a vent assembly or method which includes all of the various components described below in connection with the illustrated embodiments.

In accordance with a first embodiment, a vent assembly is described for controlling the flow of air through an opening. The assembly comprises a vent cover with a plurality of air flow openings. An air flow regulator is slidable relative to the vent cover from a first closed position in which the air flow regulator substantially blocks the flow of air through the air flow openings to second open positions in which air flow paths are provided through the air flow regulator and air flow openings. By substantially blocking the flow of air, it is meant that air flow is severely restricted as some air flow leakage or minimal air flow may still take place even though the air flow regulator is in the closed position. One or more open positions may be provided with air flow being less restricted by the air flow regulator as the air flow regulator is moved toward its most open position. In this embodiment, plural couplers may be used to slidably couple the air flow regulator to the vent cover. These couplers may each comprise at least one first coupler portion coupled to the air flow regulator and at least one second coupler portion frictionally coupled to the vent cover. The at least one second coupler portion may be inserted into a coupler receiving opening in the vent cover, such as into an air flow slot between vanes of the vent cover. The second coupler portion may frictionally engage the boundaries defining the receiving opening, such as the vanes, to retain the air flow regulator in a coupled relationship to the vent cover.

As another aspect of an embodiment, the air flow regulator may comprise plural guide openings through which the plural couplers respectively extend with the first coupler portion and at least one second coupler portion being on opposite sides of the air flow regulator from one another. The guide openings may engage the plural couplers to guide the sliding motion of the air flow regulator. In desirable forms, the air flow guide openings may comprise elongated slots oriented in a direction parallel to the direction in which the air flow regulator slides.

Couplers which engage the air flow regulator may have a portion which is compressed when inserted into a respective coupler receiver opening. The compressible member engages the vent cover within the coupler receiving opening to couple the air flow regulator to the vent cover. The compressible member may comprise a spring wire. In addition, the compressible member may be designed for compression in at least two directions when inserted into a coupler receiving opening.

In one embodiment, the vent assembly may comprise a vent cover comprising opposed outer and inner major surfaces with air flow openings extending between the outer and inner major surfaces. An air flow regulator may comprise first and second major opposed air flow regulator surfaces. When assembled, the first air flow regulator surface in this embodiment may be positioned adjacent to the inner major surface of the vent cover. A plurality of couplers each comprising a spring clip may be used to slidably couple the air flow regulator to the vent cover. The respective spring clips may each comprise at least two second coupler portions which are spaced apart from one another and a first coupler portion which interconnects the at least two of the second coupler portions. The first coupler portion may comprise an air flow regulator support portion which is coupled to the second air flow regulator surface to support the air flow regulator. The air flow regulator support portion may be positioned parallel to the second air flow regulator surface. The first coupler portion may lack any portion which projects away from the second air flow regulator surface. In an alternative form, the first coupler portion may comprise a duct retaining portion which projects away from the second air flow regulator surface.

As a further aspect of the last described embodiment, the vent cover may comprise first and second vent cover side portions and a plurality of spaced apart vanes extending between the first and second vent cover side portions. The air flow openings may comprise elongated air flow slots having sides bounded by respective vanes and ends bounded by respective portions of the first and second vent cover side portions. The second coupler portions may have a first dimension in a first direction which is greater than the spacing between the first and second of said vanes. The second coupler portions may also be oriented relative to the vent cover such that the second coupler portions are compressed in the first direction by the first and second vanes upon insertion of the second coupler portions into an air flow slot between the first and second vanes to thereby couple the air flow regulator to the vent cover. As another aspect of an alternative embodiment, the second coupler portions of each coupler may be spaced apart a distance which is greater than the distance between the ends of the air flow slot. In this case, the second coupler portion may be configured so as to be compressed in a second direction toward one another by the respective portions of the first and second vent cover side portions which define the air flow slot when the second coupler portions are inserted into the air flow slot.

The second coupler portions may be configured so as to be compressed in only the first direction to couple the air flow regulator to the vent cover; to be compressed in only the second direction (although this is less desirable) to couple the air flow regulator to the vent cover; or be compressed in both the first and second directions to accomplish the desired coupling. The second coupler portions in this embodiment may otherwise be compressible to accomplish this coupling.

As another aspect of an embodiment, the vanes may define slots oriented at a first angle relative to the inner major surface of the vent cover. In addition, the second coupler portions and air flow regulator support portions of the couplers may be at a second angle from one another with the second angle being less than the first angle.

The second coupler portion may comprise at least a portion of a loop of spring wire having a first dimension in the first direction.

In accordance with one specific embodiment, only two of said couplers are provided with one being positioned adjacent a first end portion of the vent cover and another being positioned adjacent a second end portion of the vent cover. Each of the couplers may include only two of said second coupler portions. In addition, the air flow regulator may comprise a respective guide slot or opening adjacent to each of the second coupler portions for guiding the motion of the air flow regulator relative to the vent cover.

It should be noted that in accordance with alternative embodiments, other forms of couplers may be utilized for slidably interconnecting the air flow regulator to the vent cover. Although less desirable, for example, fasteners extending through guide slots in the air flow regulator may engage the undersurface of the vent cover to slidably suspend the air flow regulator from the vent cover. Thus, although less desirable, friction or compressible couplers are not required to be used in the various embodiments.

As yet another aspect of an embodiment, at least one actuator coupled to the air flow regulator may be used to slide the air flow regulator relative to the vent cover from the closed to the open positions and back. Desirably, the air flow regulator extends into at least one of the air flow openings of the vent cover. The actuator may be movable within the air flow opening, which may comprise an air flow slot, and relative to the vent cover between respective first and second positions. As the actuator moves, the air flow regulator, which may comprise a slide member, slides from a first closed position in which the air flow regulator impedes the flow of air through the air flow slots to at least one second open position in which the slide member is positioned to open the air flow slots for the flow of air therethrough.

In accordance with an embodiment of a vent assembly, the air flow openings through the vent cover may comprise an elongated first air flow slot extending in a first direction. The air flow regulator may be slidable in either direction along a path of travel which is skewed relative to the first direction. More typically, the path of travel of the air flow regulator is perpendicular to the first direction. A movable actuator may be slidable in either direction along the first air flow slot. In addition, the air flow regulator may comprise an actuator cam which may comprise a guide slot extending in a second direction which is skewed relative to the first direction and skewed relative to the path of travel. The actuator may also comprise a cam follower which engages the cam such as a portion of the actuator positioned in the actuator guide slot. In this construction, movement of the actuator in one direction along the first air flow slot slides the air flow regulator toward the closed position and movement of the actuator in another direction opposite to the one direction along the first air flow slot slides the air flow regulator toward the open positions. In a desirable form of this embodiment, the vent cover has a longitudinal axis with the first direction being perpendicular to the longitudinal axis of the vent cover. In addition, the path of travel of the air flow regulator may be parallel to the longitudinal axis. In addition, the actuator guide slot may extend in a second direction which is at an acute angle relative to the first direction. Although variable, the acute angle, in one specific example may be 35 degrees.

As yet another embodiment, the acutator may comprise a lever having a first portion coupled to the air flow regulator, a pivot portion positioned at least partially within at least a first of the air flow openings, and a grasping portion projecting from the pivot portion and generally away from the air flow regulator. In this construction, pivoting of the lever in a first direction slides the air flow regulator toward the closed position and pivoting the lever in the opposite direction slides the air flow regulator toward the open positions. In a specific embodiment, the lever may be configured such that the pivot portion moves in a first direction toward the outer surface of the vent cover as the lever is pivoted from a closed position toward the open positions. In a more specific design, the pivot portion of the lever may be enlarged with curved outer surfaces. The curved outer surfaces may be positioned to engage and pivot against portions of the vent cover defining the first of the air flow openings in which the pivot portion is disposed. The air flow regulator may comprise a lever engaging portion coupled to the first lever portion. For example, the lever engaging portion may have a lever receiving slot. The first lever portion of the lever may have a distal end portion spaced from the pivot portion and comprising a tab with a shoulder sized such that the tab is insertable into the lever receiving slot with the shoulder engaging the slot. In addition, the first lever portion may be bent at a location between the shoulder and pivot portion. In a specific form, the first lever portion is not straight.

In one embodiment, the vent assembly supports the vent cover at an acute angle relative to horizontal when the vent assembly is installed, forty-five degrees is one specific example of the acute angle, although this is variable. The vent assembly may comprise vent cover supports having a first edge which support the vent cover at the acute angle. A building may comprise a plurality of vent assemblies of the various embodiments heretofore described.

In addition, vent assembly methods are also disclosed.

BRIEF DESCRIPTION OF THE DRAWINGS

FIG. 1 is a perspective view of one form of a vent cover assembly in accordance with an embodiment of the present invention.

FIG. 2 is a bottom view of a vent assembly in accordance with a second embodiment.

FIG. 5 illustrates one form of actuator for shifting the air flow regulator between open and closed positions with the actuator shown in an air flow regulator open position in FIG. 5.

FIG. 6 is similar to FIG. 5 with the actuator shown in an air flow regulator closed position in FIG. 6.

FIG. 7 is a perspective view of the actuator embodiment shown in FIGS. 5 and 6.

FIG. 8 is a side elevational view of the actuator of FIG. 7.

FIG. 9 illustrates a vent assembly with one form of a coupler for coupling an air flow regulator or slide member to a vent cover.

DESCRIPTION OF ILLUSTRATED EMBODIMENTS

Figure 4A:
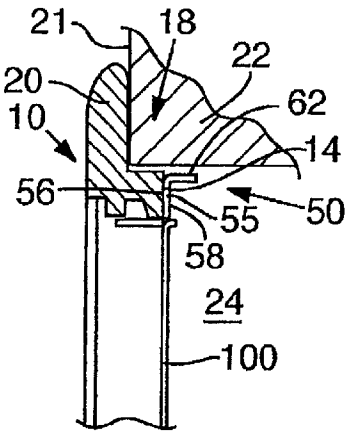
FIG. 4A is a transverse sectional view of a portion of the vent assembly of FIG. 3 taken along line 4A—4A of FIG. 3.

FIG. 1 illustrates one form of vent assembly comprising a vent cover 10, which may be of any suitable durable material such as metal or wood, with wood being a desirable example. The illustrated vent cover has first and second major opposed surfaces 12,14 with a plurality of vent openings, some being indicated at 16, which extend between surfaces 12,14 and through which air may flow. The illustrated vent cover 10 has an inward step around its perimeter, as indicated at 18, with an overhanging projecting rim portion 20 about the perimeter of the vent cover. As can be seen in FIG. 4A, the undersurface of rim 20 may engage the upper surface 21 of a portion of a floor 22 or other support through which a duct opening 24 extends. The step 18 allows the vent cover to be inserted downwardly into the duct opening.

The air flow openings 16 in the illustrated vent cover may be of any configuration and comprise elongated slots which are spaced apart from one another by respective vanes. Two of these air flow slots are indicated at 26 in FIG. 1. These vanes have wall surfaces which bound the respective sides of the air flow slots and are typically angled to assist in directing air as it flows outwardly from the vent assembly. The vanes 26 extend between respective side members or portions 28,30 of the illustrated vent assembly. Side members 28,30 bound the respective ends of the air flow slots 16. First and second end members or portions 32,34 extend between the respective side members 28,30 at the respective ends of the vent cover and complete a frame around the perimeter of the vent cover. A central crosspiece 36 is also provided approximately midway between the respective ends of the vent cover 10. The crosspiece 36 also passes between side members 28,30. The air flow slots 16 toward the right side of crosspiece 36 in FIG. 1 may be angled to direct air away from the crosspiece. The slots at the opposite side of the crosspiece are typically angled in the opposite direction. One of these air flow slots, in FIG. 1 the endmost air flow slot indicated at 16*a* to distinguish it from the other slots 16, has a vent assembly actuator indicated generally at 40 positioned, in this example at least partially therein. Actuator 40 is used to shift the position of an air flow regulator such as a slide member. The air flow regulator is slidably coupled to the vent cover 10 so as to be slid to various positions to control the flow of air from the duct and through the air flow slots 16.

Figure 3:
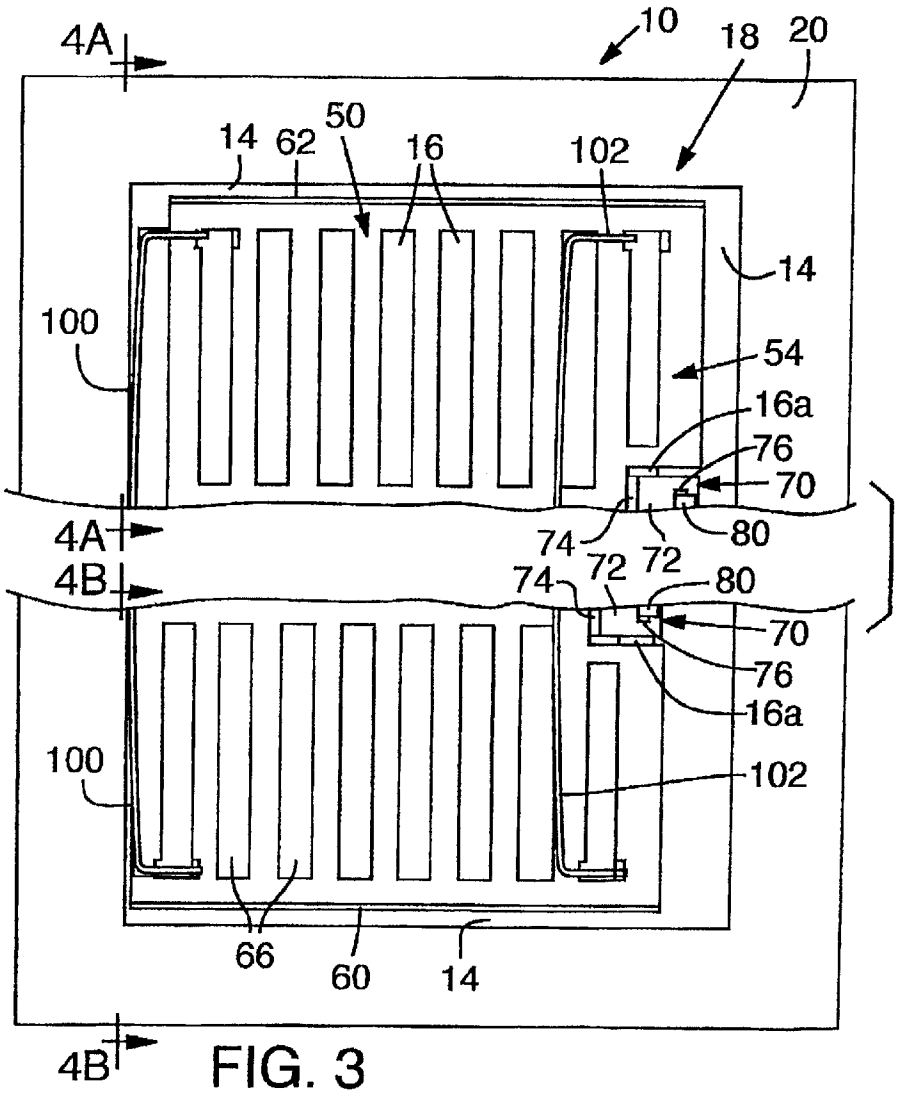
FIG. 3 is a view similar to FIG. 2 with a slide member or air flow regulator shown in a fully opened position in the upper portion of FIG. 3 and in a closed position in the lower portion of FIG. 3.
Figure 4B:
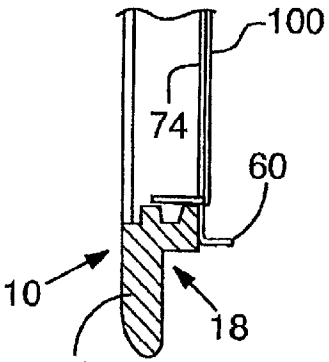
FIG. 4B is a transverse sectional view of a portion of the vent assembly of FIG. 3 taken along line 4B—4B of FIG. 3.

FIG. 2 illustrates the underside of a form of vent assembly having a vent cover 10 like that shown in FIG. 1 except that the vent cover is of a shorter length than that shown in FIG. 1 and lacks the central crosspiece 36. FIG. 2 illustrates one form of an air flow regulator 50 which is slidably coupled to the vent cover 10. In the form shown, the air flow regulator comprises a slide member 54 which may comprise a generally planar plate 55 having opposed first and second major surfaces 56,58 (see FIG. 2 and FIG. 4A). In the embodiment shown, the surface 56 is an upper surface of plate 54 and is positioned adjacent to the surface 14 of the vent cover 10. In addition, the surface 58 is spaced away from the surface 14 and is exposed to view in the embodiment of FIG. 2 when looking at the rear of the vent assembly. The plate 55 has first and second reinforcing side flanges 60,62. The respective flanges 60,62 project outwardly away from the surface 58 and away from the vent cover surface 14. The illustrated slide member 54 has a plurality of spaced apart air flow openings extending between the surfaces 56,58 with some of these openings being indicated at 66 in FIG. 2. Openings 66 may take any convenient configuration. In the illustrated form, these openings comprise elongated rectangular slots extending transversely relative to the longitudinal axis of the plate 55. In FIG. 2, the slide member 54 is shown positioned in a fully opened position. In this position, the slots 66 are aligned with corresponding air flow openings 16 of the vent cover. Consequently, minimal resistance is provided to the flow of air upwardly through the slide member and vent cover. In contrast, when slide member is shifted to a fully closed position, the portions of the slide member between the openings 66 are aligned with the air flow openings 16 through the vent cover. This substantially blocks the flow of air through the vent cover. Intermediate open positions are also possible depending upon the extent of the alignment of openings 66 with openings 16. The upper portion of FIG. 3 shows the vent assembly of FIG. 2 with the slide member 54 in the open position. This corresponds to the position shown in FIG. 2. In contrast, the lower portion of FIG. 3 illustrates the vent assembly of FIG. 2 with the slide member 54 shifted to the closed position. FIG. 4A shows a portion of the vent assembly of FIG. 3 in the open position. FIG. 4B shows a portion of the vent assembly of FIG. 3 in the closed position.

FIG. 2 also illustrates one form of an actuator engaging portion 70 of the slide member 54. As can be seen in FIGS. 5 and 6 in connection with one specific form of actuator 40, the actuator engaging member 70 comprises a lower portion 72 spaced below the surface 58 and coupled by a downwardly projecting flange portion 74 to the main body of the slide member 54. Portion 72 of activator engaging member 70 in the form shown is provided with an opening or slot 76 for receiving a toe or tab portion 80 of the actuator embodiment shown in FIGS. 5, 6 and 7.

Although not required, for economic efficiency, slide member 54 may be formed out of a single sheet of material by simply cutting and bending the sheet in an appropriate manner. As a specific example, the slide member 54 may be formed of 18 to 20 gauge C.R. low carbon steel. The various embodiments are not limited to the form of actuator engagement mechanism shown at 70.

Various forms of couplers may be used to slidably mount the slide member 54 to the vent cover 10. For example, screws or other fasteners may extend through slots in the slide member and into the vent cover, such as into surface 14. By making the width of the slots less than the cross-sectional dimensions of a fastener head, the slide member is maintained in place. Although such approaches may be used, they are less desirable in some applications. For example, if the vent cover is made of oak or other wood, fasteners may split the wood when they are installed. In addition, if the fasteners are tightened too tight, too much resistance to sliding can result. In contrast, if the fasteners are too loose, the slide member may rattle and make noise during use. Therefore, the Applicant has found that detachable couplers, particularly those which require no tools for installation, are particularly desirable. These couplers may take any number of forms. However, in one desirable form such couplers may comprise at least one first coupler portion coupled to the air flow regulator so as to permit sliding movement of the air flow regulator or slide member. In addition, such couplers typically comprise at least one second coupler portion which engages the vent cover. Although other engagement mechanisms may be used, desirably, the second coupler portion frictionally engages the vent cover. As a specific example, second coupler portions which are compressed in at least one direction within coupler receiving openings of the vent cover may be used. As a specifically desirable example, the coupler receiving openings in the vent cover may comprise one or more of the air flow openings. A particularly desirable form of coupler is a clip which may be formed of any suitable material. As a specific example, the couplers may be made of spring steel wire bent into an appropriate shape.

Typically, plural couplers are used to couple the slide member to the vent cover. Two or more couplers may be used in desirable examples. Two couplers in the form of clips 100,102 of an exemplary embodiment, are shown in the vent assembly of FIG. 2.

The operation of the exemplary actuator 40 mentioned above will be best understood with reference to FIGS. 5, 6, 7 and 8. More specifically, with reference to FIG. 7, the actuator 40, in the form shown, comprises a lever 84 having a first portion 86 which is coupled to the air flow regulator. More specifically, in the embodiment shown, the tab 80 projects from the lever first portion 86 for insertion into the opening 76 of actuator receiving portion 72 of the slide member. In addition, the illustrated lever 84 includes a pivot portion 88 which, as can be seen in FIG. 5, in the illustrated embodiment, is positioned at least partially within the slot 16*a* of the vent cover. More specifically, pivot portion 88 in the illustrated embodiment is configured for positioning entirely within the slot between walls of adjoining portions of the vent cover that define slot 16*a*. In addition, lever 84 comprises a grasping portion 90 which projects from the pivot portion and generally away from the air flow regulator or slide member 54 when the vent assembly is assembled.

As can be seen in FIGS. 5, 6 and 7, the first or lower lever portion in the illustrated embodiment is not straight. In particular, the first lever portion 86 is bent, in this case, between the pivot portion and the tab 80. In addition, a shoulder 92 is provided between tab 80 and the lever portion 86. As can be seen in FIGS. 5 and 6, the shoulder 92 bears against the slot 76 as the acutator is operated.

FIG. 5 illustrates the slide member 54 in a fully open position. Lever 84 is pivoted in the direction indicated by arrow 94 to open the vent assembly. In contrast, FIG. 6 illustrates the vent assembly in the closed position. The lever 84 is pivoted in the direction indicated by arrow 96 to close the vent assembly. As can be seen in FIGS. 5 and 6, curved exterior surfaces of the pivot portion 88 engage the walls defining slot 16*a* to guide this pivoting motion. In addition, with the configuration shown, as the actuator is pivoted toward its open position in the direction of arrow 94, the distance $d_1$ between the pivot axis of pivot portion 88 and the undersurface 14 of vent cover 10 increases. That is, the pivot axis is shifted closer to vent cover surface 12. In one specific configuration, the distance $d_1$ is 0.267 inches. In contrast, as the lever 84 of this configuration is shifted toward its closed position in the direction of arrow 96 in FIG. 6, the distance between the pivot axis of pivot portion 88 and surface 14 is decreased. This is indicated by $d_2$ in FIG. 6. With the specific example shown, $d_2$ may be 0.22 inch. Thus, in effect, one form of lever 84 includes a floating pivot which moves toward the upper surface 12 of the vent cover 10 as the actuator is shifted toward its open position. This assists in maintaining the upper portion of lever 84 at a location where it is easier to reach for use in adjusting the position of the slide member 54.

Although the dimensions of the lever form of actuator shown in FIGS. 5, 6, 7 and 8 may vary, specific exemplary dimensions for a construction in which the distance between surface 58 of slide member 54 and the upper surface of engaging member 72 is 0.244 inch are as follows. The lettering and angle designations set forth below correspond to the lettering and angles used in FIG. 8.

$\theta$=25 degrees $L_1$=0.110 inch $L_2$ 0.401 inch $L_3$ 0.250 inch $L_4$=0.358 inch $L_5$=0.104 inch $L_6$=0.138 inch T–0.057 inch In addition, the width of the lever 84 may be 0.609 inch and width of the tab 80 may be 0.157 inch. The actuator lever 84 may be made of any suitable material and may, for example, be extruded of aluminum with the extrusion being separated into actuators of the appropriate width and with the tab 80 being formed by machining.

Figure 10:
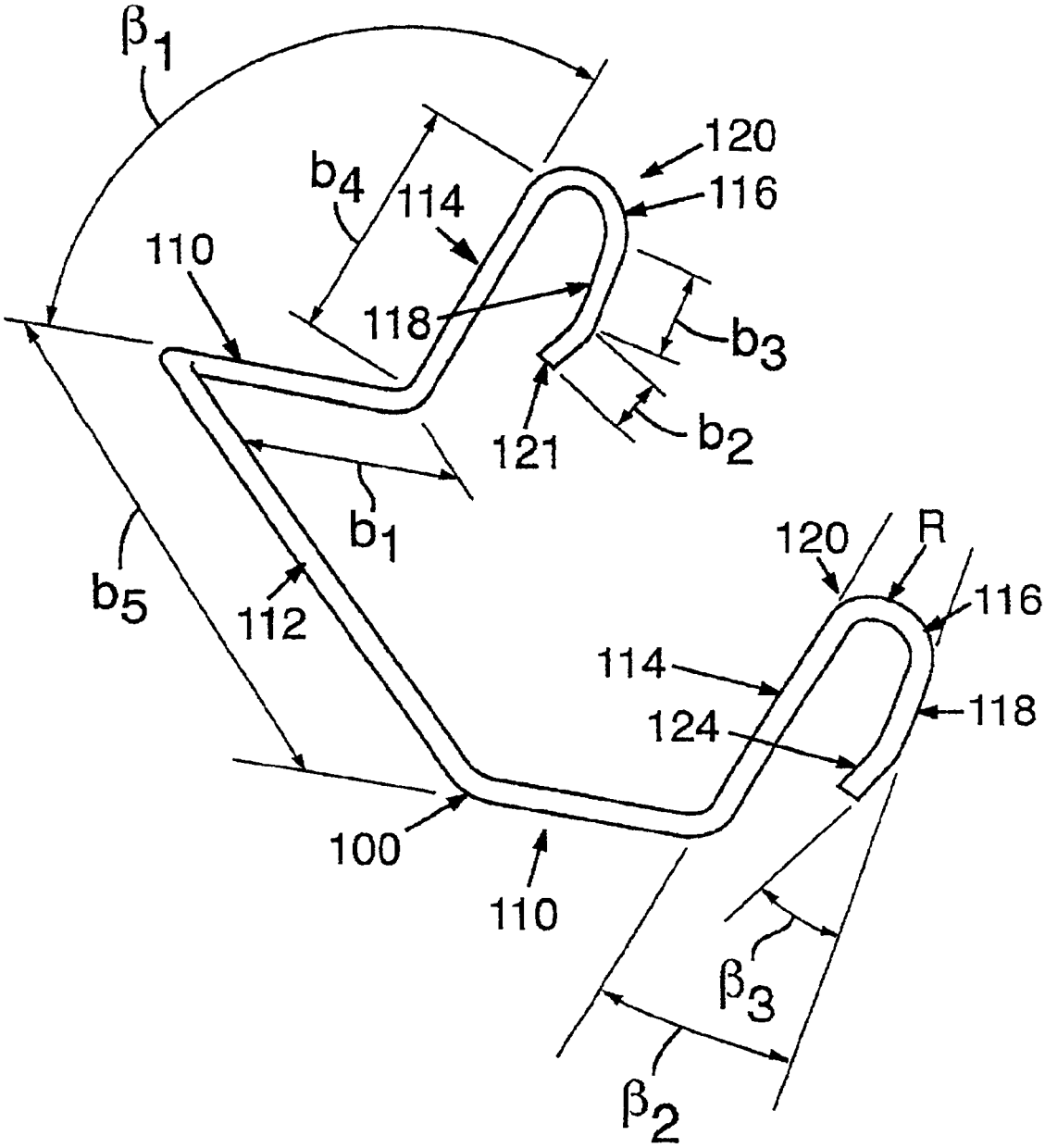
FIG. 10 is a perspective view of one of the couplers of FIG. 9.

The clips 100,102 may take a number of forms. One exemplary form of clip is illustrated in FIGS. 9 and 10. With reference to FIG. 9, the air flow openings 16,16*a* through vent cover 10, as mentioned above, are defined by vanes 26 and respective portions of the end pieces 32,34. More specifically, the air flow openings are defined by respective spaced apart and adjacent walls 104,106 of these components. The walls may be angled relative to horizontal such as indicated in FIG. 9. An exemplary angle is indicated at ∝ in FIG. 9. Although variable, an exemplary angle is about 117 degrees. In addition, the walls 104,106 are spaced apart a distance $V_t$ in FIG. 9 corresponding to the width of the air flow slots 16. Although the dimensions of the air flow slots may vary, an exemplary $V_t$ is 0.3 inch.

The clips 100,102 may be identical to one another or, although less desirable, they may be of a different configuration. In the example of FIG. 9, clips 100,102 are identical. Therefore, only clip 100 will be described in detail in connection with FIG. 10. The illustrated clip 100 comprises a first coupler portion comprised of respective spaced apart air flow regulator support portions 110 interconnected by a portion 112. As can be seen in FIG. 9, support portions 110 support the slide member 54 from below. That is, portions 110 are typically positioned adjacent to surface 58 of the slide member 54. In addition, the illustrated clip 100 includes at least two coupler portions 120 which are spaced apart from one another. These coupler portions have a cross-sectional dimension in one direction (the direction corresponding to the distance $V_t$) which is greater than the distance $V_t$. Consequently, when the coupler portions 120 are inserted into a receiving air flow slot 16 or 16*a*, the coupler portions 120 are compressed in said at least one dimension for wedging or frictional fit within the receiving opening. As a result, the slide member 54 is held in place without requiring tools to interconnect the slide member to the vent cover in this example. The illustrated coupler portions 120 are each comprised of an upwardly extending leg portion 114, a curved end portion 116, and a downwardly extending leg portion 118 with an inwardly directed distal end portion 121.

Referring back to FIG. 2, at the location where clip portion 110 extends upwardly or transitions to the portion 114, an associated guide opening is provided through the slide member 54. These guide openings may comprise respective slots having longitudinal axes extending in a direction which is parallel to the direction of travel of the slide member 54 relative to the vent cover 10. These slots may be of a width which is slightly wider than the thickness of wire used to form the illustrated clips. These slots are indicated at 124 in FIG. 2.

Desirably, the angle $\beta_1$ (FIG. 10) between support portion 110 and leg portion 114 is less than the angle ∝ (FIG. 9). Consequently, as can be understood from FIG. 9, when the clip is installed (e.g., clip 100) an upwardly directed biasing force is exerted by the spring clip against the slide member 54. For example, in FIG. 9, with the slide member 54 in the fully open position, the support portion 110 of clip 100 at a location adjacent to clip portion 112 has sprung against the undersurface 14 of vent cover 10. As the vent cover is shifted toward its closed position from the open position shown in FIG. 9, the portion of the slide member 54 immediately above support portion 110 of clip 100 urges the portion of clip 100 at the intersection between portions 110 and 112 away from the surface 14. The clip 100 in this form hold the slide member securely in place against the undersurface 14 of the vent cover.

Although variable, in one specific illustrative example, the dimensions of clip 100 and configuration of the clip are as follows:

$\beta_1$=110 degrees $\beta_2$=10 degrees $\beta_3$=15 degrees

R=0.073 inch radius of curvature $b_1$=0.440 inch b2=0.133 inch b3=0.244 inch b5=variable depending upon the width of the vent with b5 typically being less than the width of the air flow slots. For example, b5 may be about 1.3 inch for a 2¼ inch vent, about 3.1 inch for a 4-inch vent, and about 5.1 inch for a six-inch vent width. The angle $\beta_3$ is included to minimize the possibility of the distal end 121 of the clip hanging up on the wall of the associated vent opening when the clip is removed. As a specific example, the clip 100 may be formed of 0.047 gauge music wire with 0.047 inch bend radii except for the radius R.

Figure 11:
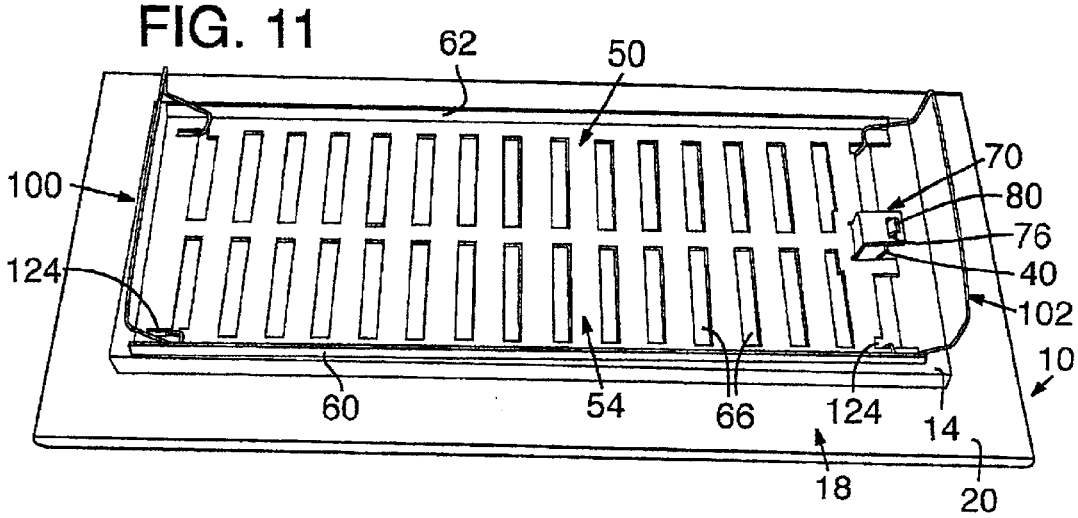
FIG. 11 is a perspective view of an alternative embodiment of a vent assembly illustrating another form of a slide member or air flow regulator and couplers.
Figure 12:
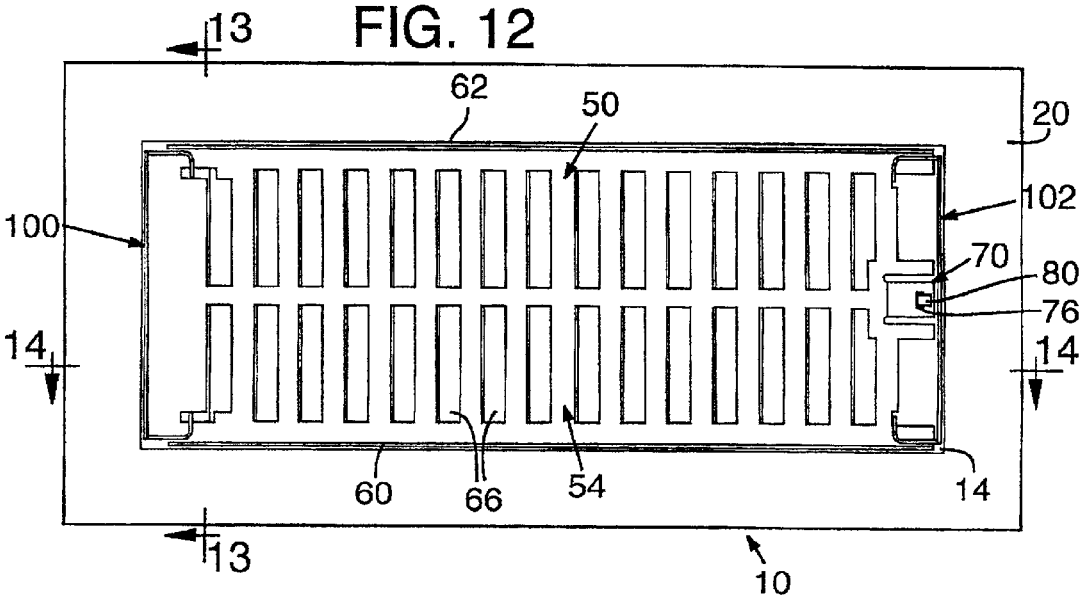
FIG. 12 is a bottom plan view of the vent assembly and air flow regulator of FIG. 11.
Figure 13:
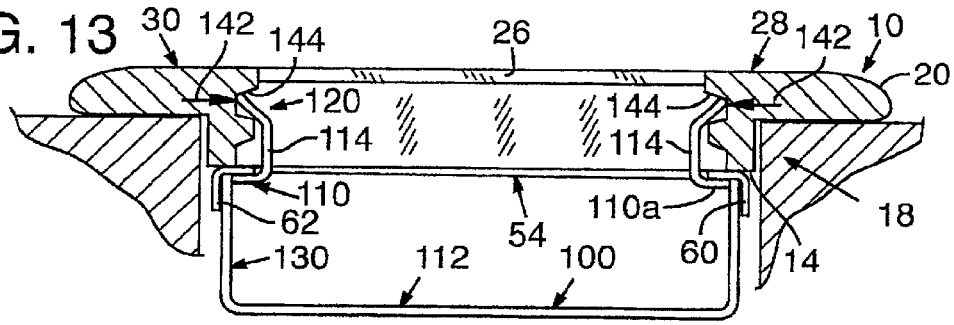
FIG. 13 is a transverse sectional view, taken along line 13—13 of FIG. 12, and illustrating a different form of coupler from than the coupler shown in FIG. 10.
Figure 14:
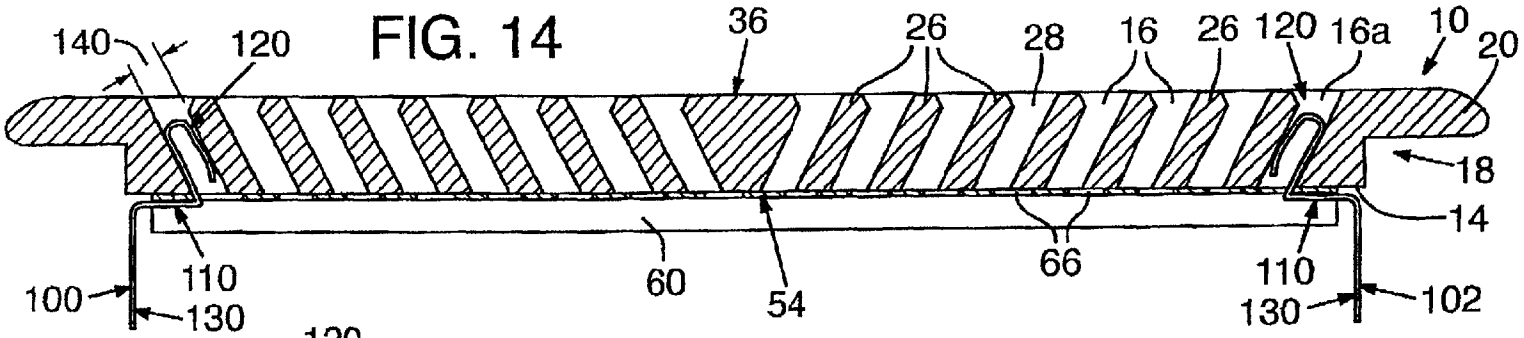
FIG. 14 is a longitudinal sectional view of the vent assembly of FIG. 12 taken along line 14—14 of FIG. 12.
Figure 15:
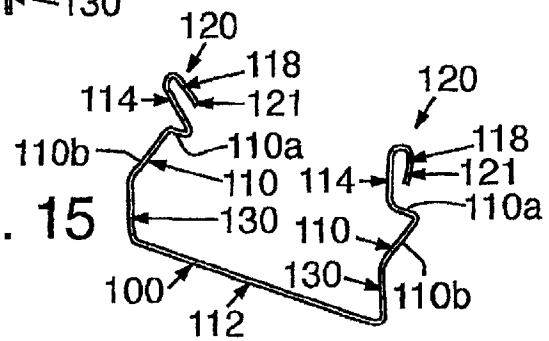
FIG. 15 is a perspective view of a form of coupler usable in the FIG. 14 embodiment.
Figure 16:
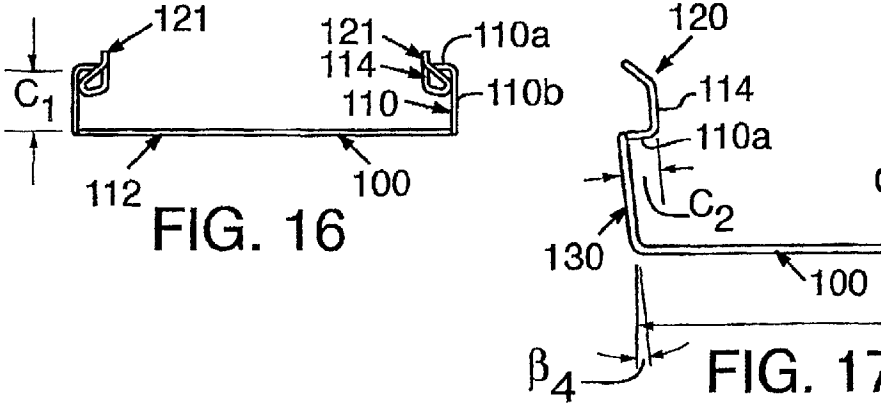
FIG. 16 is a top view of the coupler of FIG. 15.
Figure 17:
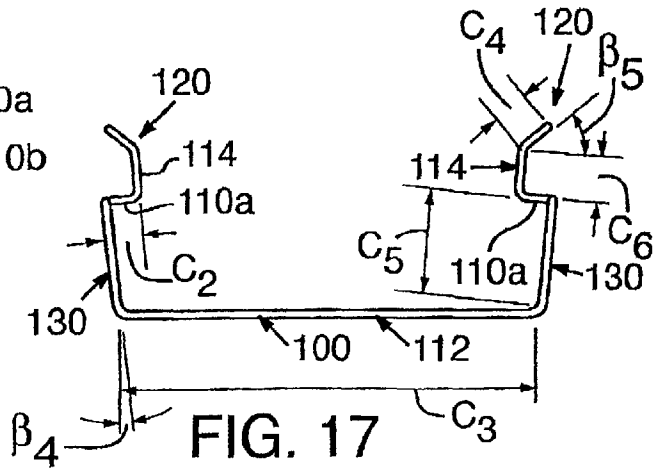
FIG. 17 is a front elevational view of the coupler of FIG. 15.
Figure 18:
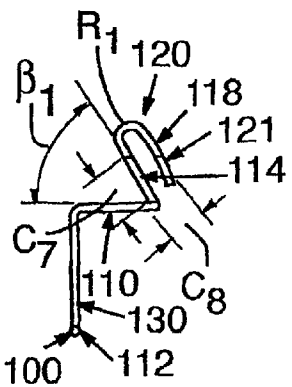
FIG. 18 is a side elevational view of the coupler of FIG. 15.

FIGS. 11-18 illustrate an alternative embodiment of vent assembly. In these figures, corresponding components, even if they differ somewhat in configuration, have been given the same numbers as in the previously described embodiments. As can be seen in FIG. 11, the guide slots 124 are of a different configuration in this construction. The slot 124 at the end of the slide member 54 adjacent to actuator engaging portion 70, these slots are open at one end. In addition, the clips have a downwardly or rearwardly extending retention portion such as indicated as 130 in FIG. 13. The retention portion typically extends into the duct covered by the vent assembly and provides some resistance to the vent assembly being knocked out of the duct opening in the event the vent assembly is impacted. This optional feature may be included in the clips shown in FIG. 10 and typically are more desirable in applications where the vent is installed over thick carpet. In addition, clips of the form shown in these figures have a slide member engaging portion 110 having a first portion 110B which extends generally in a direction parallel to the motion of travel of the slide member in an inwardly directed portion 110A as can be seen in FIG. 17, the clip 100 in this illustration has coupling portions 120 which diverge away from one another at the upper end of the clip in this figure. The distance between the farthest apart portions of coupling sections 120 of the FIG. 17 form of clip, may be greater than the width of the opening which receives the clip. Consequently, when the clip of the form of FIG. 17 is installed in such an example, a dual biased or dual compression coupling is achieved. That is, the coupling portions 120 are compressed by the walls which define the slot within which the clips are inserted (see FIG. 14) with the walls compressing the clip in the directions indicated by arrows 140. In addition, the clip is compressed by the end pieces 28,30 in the directions indicated by arrows 142 in FIG. 13. In addition, the vent cover 10 may have respective grooves 144 extending in a direction opposite to arrows 142 into the side edges of the respective pieces 28,30. The clips may be configured such that the coupling portions 120 engage these grooves when they are compressed and inserted. Alternatively, the coupling portions 120 may be angled toward one another such that they are spaced apart a distance which is less than the width of the receiving slot. In such a case, a single direction compression fit is provided as the ends 28,30 bounding the slots would typically not be engaged with such a clip configuration.

Although variable, exemplary dimensions for one specific example of a clip of the form shown in FIGS. 15-18 is as follows:

$c_1$=0.500 inch $c_2$=0.227 inch $c_3$=variable depending upon the width of the vent cover. In the FIG. 13 form, $c_3$ is slightly greater than the width of the slot which receives the clip 100. In other embodiments, $c_3$ is comparable to the width $\beta_5$ in the FIG. 10 example.

$c_4$=0.291 inch $c_5$=0.907 inch $c_6$=0.348 inch $c_7$=0.390 inch $c_8$=0.274 inch $R_1$=0.06 inch radius (again indicating the variability of this radius as see for example R in FIG. 10 as an alternative).

$\beta_1$=for example 58 degrees to 63 degrees.

$\beta_4$=in the form shown in FIG. 17, 5 degrees although as explained above, coupler components 120 may converge rather than diverge in which case $\beta_4$ would be different.

$\beta_5$=42 degrees

Again, these measurements are exemplary only as they may be varied significantly and forms of couplers other than clips or friction fit couplers may be used.

Figure 19:
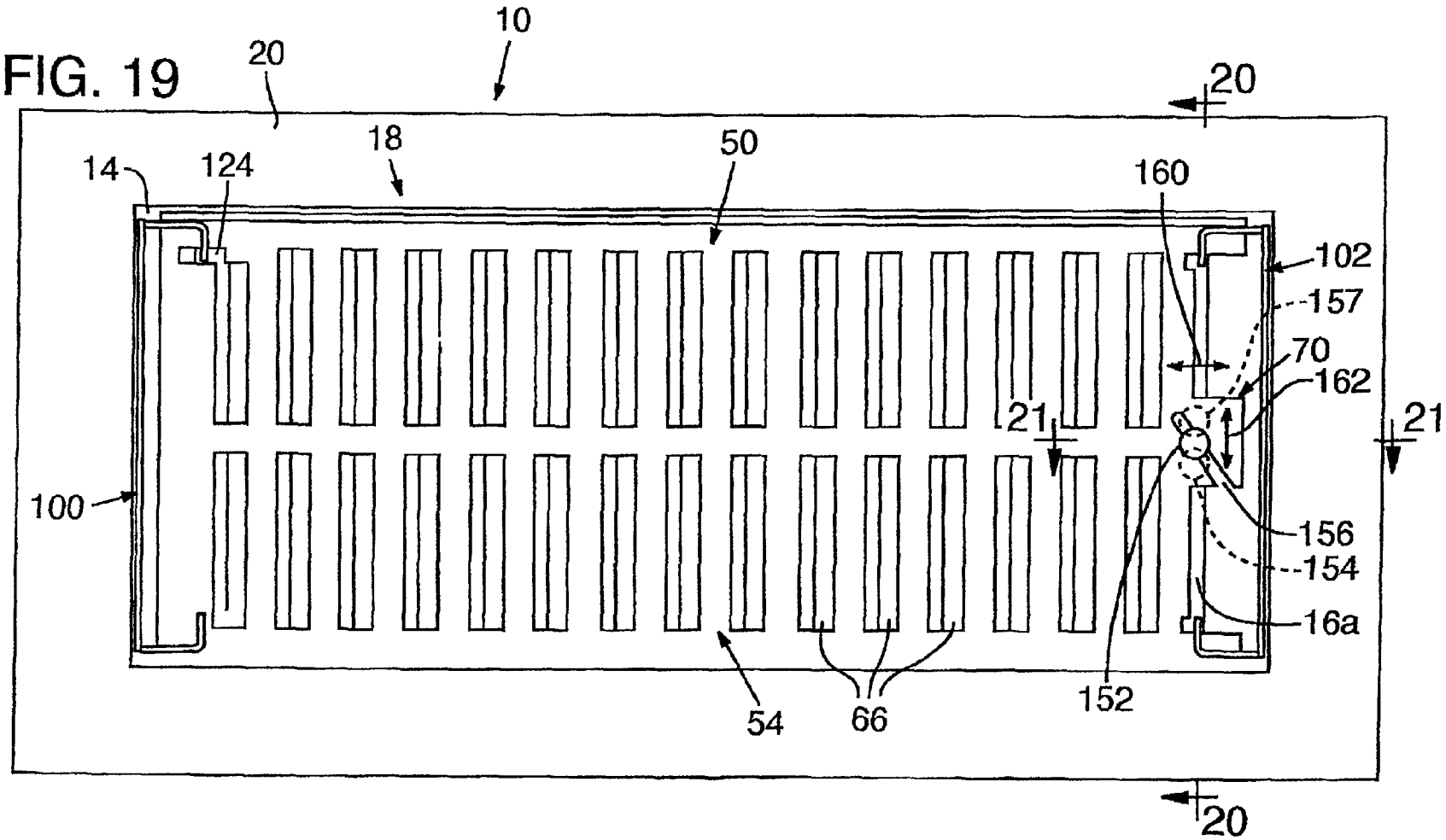
FIG. 19 illustrates an alternative embodiment of a vent assembly utilizing yet another form of actuator for shifting a slide member or air flow regulator.
Figure 20:
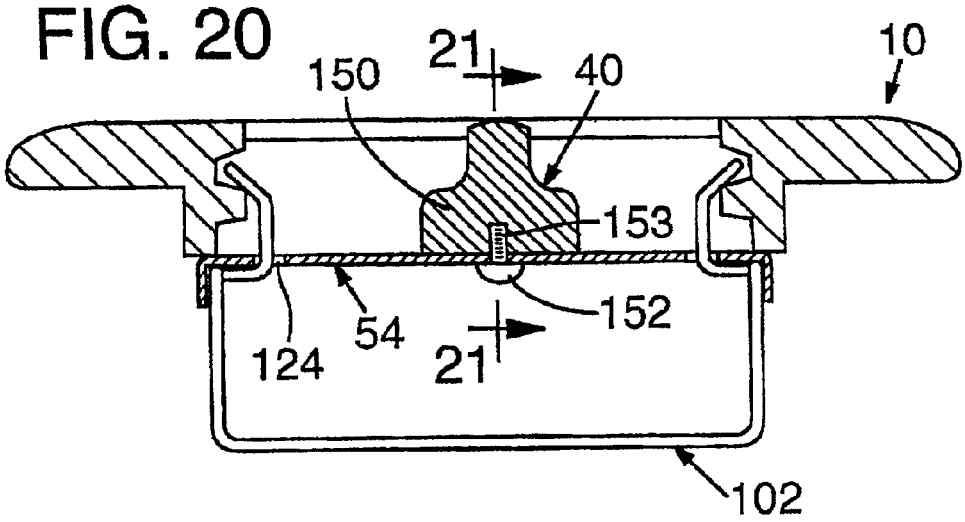
FIG. 20 is a transverse sectional view of the vent assembly of FIG. 19, taken along line 20—20 of FIG. 19.
Figure 21:
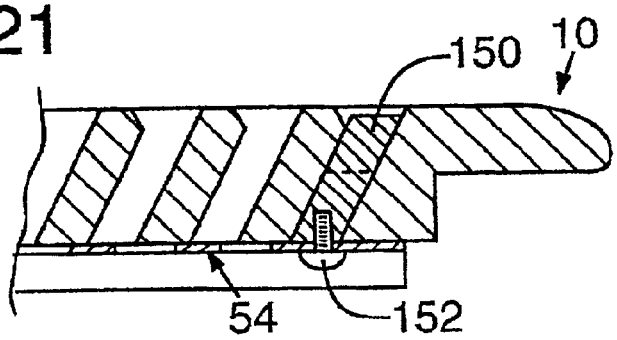
FIG. 21 is a longitudinal sectional view of a portion of the vent assembly of FIG. 19, taken along line 21-21 of FIG. 20.

FIGS. 19-21 illustrate an alternative form of vent assembly having yet another form of actuator 40 for use in sliding the slide member 54 between the closed and open positions and vice versa. In the FIGS. 19-20 embodiment, the slide member 54 is movable in a longitudinal direction as indicated by arrows 160. In addition, the air flow slot 16*a* has a longitudinal axis extending in a transverse direction which is skewed, such as perpendicular to, the path or direction of travel of the slide member. The exemplary actuator comprises an upwardly projecting grip member 150 which is positioned at least partially within the air flow slot 16*a* and desirably is accessible by a users fingers from the exterior of the vent cover. In addition, in this example, the slide member 54 comprises an actuator cam such as a guide slot 156 extending in a direction which is skewed relative to the longitudinal axis of the air flow slot and is also skewed relative to the path of travel of the slide member. The actuator comprises a cam follower portion which may, for example, be a shank 153 of a fastener secured to the underside of the actuator 150. As can be seen in FIG. 20, the exemplary fastener has an enlarged head 152 and a threaded shank 153 which is threadedly received by the actuator 150. Again, other forms of fasteners may be used. In addition, the fasteners may be omitted if another form of cam and/or cam follower is utilized. With the construction shown in FIGS. 19-21, as the actuator is moved along the air flow slot 16*a* in the respective directions indicated by doubleheaded arrow 162, the air flow regulator is caused to move between the open and closed positions. When cam follower is shifted to the position shown in dashed lines at 154 in FIG. 19, the slide member is closed. Conversely, when the actuator is shifted to the position shown in dashed lines at 157, the slide member is open.

The unique and non-obvious forms of actuators described above may be used in combination with other arrangements which permit sliding of an air flow regulator relative to a vent cover.

Other forms of actuators may be a simple grip or tab extending upwardly from the air flow regulator and into an opening such as an air flow slot. In this case, pushing the tab in one longitudinal direction opens the air flow regulator and pushing the tab in the opposite longitudinal direction closes the air flow regulator. This construction could be used for example with friction fit couplers in a unique and non-obvious combination.

Figure 22:
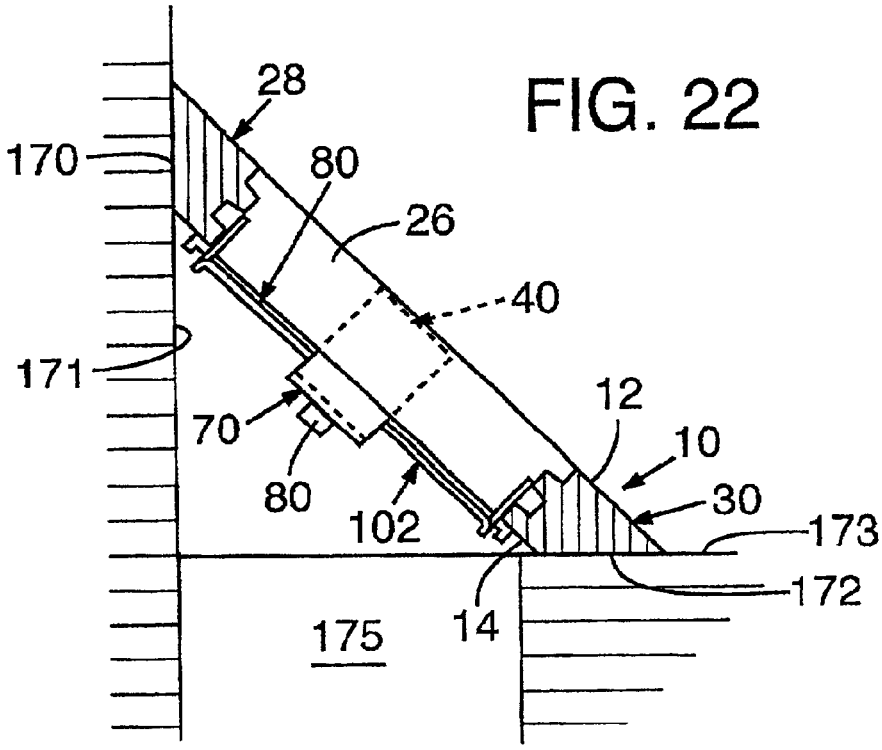
FIG. 22 illustrates a vent assembly usable at a corner location between a floor and wall of a building.
Figure 23:
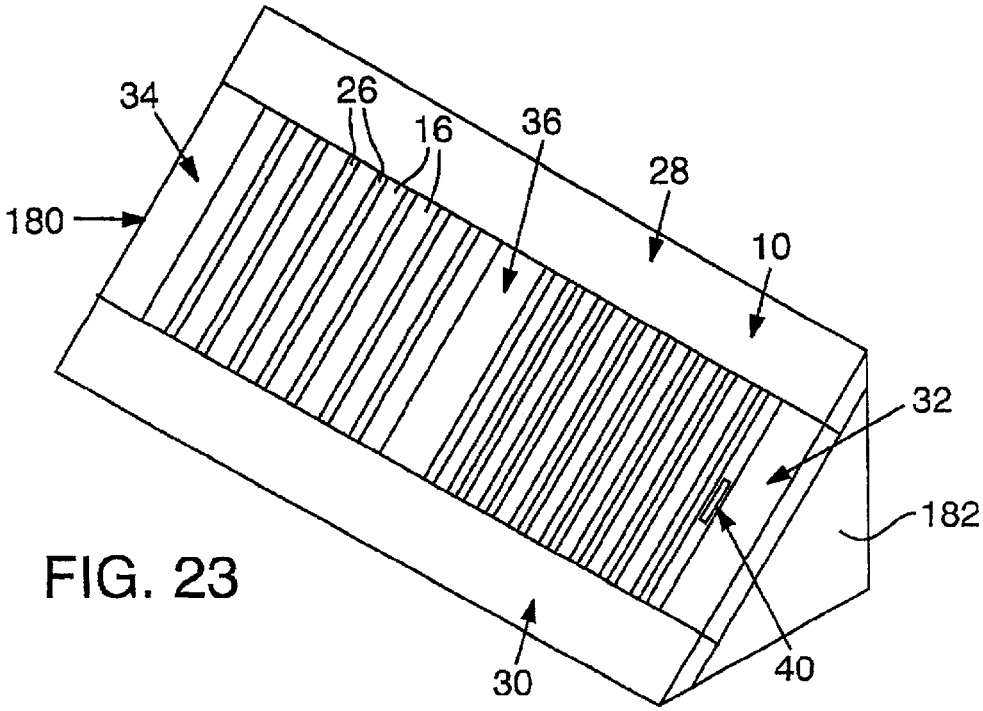
FIG. 23 is a perspective view of an alternative form of vent assembly usable in a corner application.
Figure 24:
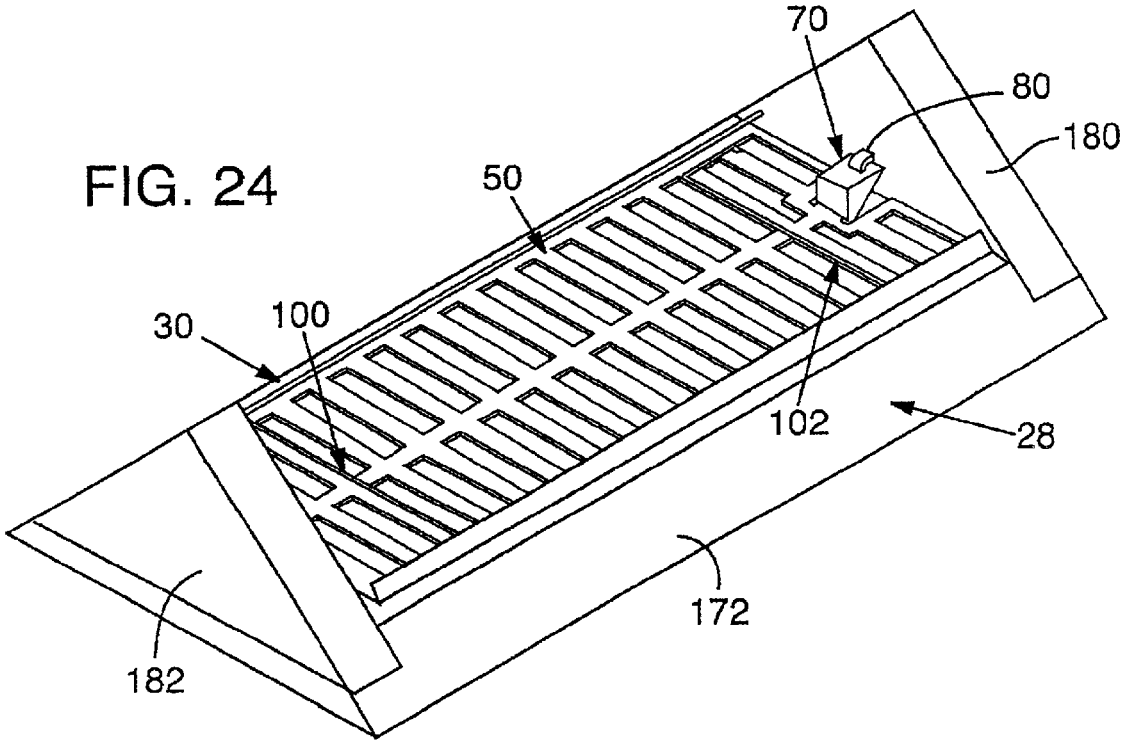
FIG. 24 is a perspective view of the underside of the embodiment of FIG. 23.

FIGS. 22-24 illustrate one form of an embodiment of a vent assembly which is suitable for a corner application. Given the low profile coupling and actuator configurations which may be used in accordance with embodiments described above, relatively little clearance is required to accommodate the vent assembly in such a corner application. By low profile, it is meant selecting components which project rearwardly from the vent cover a reduced amount. In one specific example, the side portions 28,30 of the vent cover 10 are beveled at 170,172 a desired amount for the particular application in question. For example, these edges may be beveled at 45 degree angles. As a result, edge 172 conforms to the configuration of a floor or other support 173 while edge 170 corresponds to the shape of a wall or other structure 171. A duct 175 is shown in communication with the space beneath the vent assembly of FIG. 22. FIGS. 23 and 24 illustrate assemblies of the type shown in FIG. 22 with respective end members 180,182 which may be triangular in shape. When installed, the lower edges of these end members may rest on the floor surface 173 while the upright edges of these end pieces may bear against the wall 171.

Although described in connection with several illustrative embodiments, it should be noted that the present invention is not limited to the specific configurations disclosed to illustrate the invention. The present invention is directed toward novel and unobvious aspects and method acts alone and in various combinations and subcombinations with one another. I claim as my invention all such variations as fall within the scope and spirit of the following claims:

I claim:

1. A vent assembly for controlling the flow of air through an opening, the vent assembly comprising:

a vent cover comprising a plurality of air flow openings;

an air flow regulator slidable relative to the vent cover from a first closed position in which the air flow regulator substantially blocks the flow of air through the air flow openings to second open positions in which air flow paths are provided through the air flow regulator and the air flow openings;

plural couplers slidably coupling the air flow regulator to the vent cover, each of said couplers comprising at least one first coupler portion coupled to the air flow regulator and at least one second coupler portion frictionally coupled to the vent cover.

2. A vent assembly according to claim 1 wherein the air flow regulator comprises plural guide openings through which the plural couplers extend with the first coupler portion and at least one second coupler portion being on opposite sides of the air flow regulator from one another, the guide openings engaging the plural couplers to guide the sliding motion of the air flow regulator.

3. A vent assembly according to claim 1 wherein the air flow regulator comprises plural guide slots through which the plural couplers extend with the first coupler portions being on opposite sides of the air flow regulator from the second coupler portions.

4. A vent assembly for controlling the flow of air through an opening, the vent assembly comprising:

a vent cover comprising a plurality of air flow openings;

an air flow regulator slidable relative to the vent cover from a first closed position in which the air flow regulator substantially blocks the flow of air through the air flow openings to second open positions in which air flow paths are provided through the air flow regulator and the air flow openings;

plural couplers slidably coupling the air flow regulator to the vent cover, each of said couplers comprising at least one first coupler portion coupled to the air flow regulator and at least one second coupler portion frictionally coupled to the vent cover;

wherein the vent cover comprises plural coupler receiving openings each for receiving a respective second coupler portion, each second coupler portion comprising a compressible member sized so as to be compressed in at least one direction when inserted into a respective one of the coupler receiver openings, the compressible member engaging the vent cover within the coupler receiver opening to couple the air flow regulator to the vent cover.

5. A vent assembly according to claim 4 in which the compressible member comprises spring wire.

6. A vent assembly according to claim 4 in which the compressible member is compressed in at least two directions when inserted into one of the coupler receiver openings.

7. A vent assembly according to claim 4 in which the vent cover comprises opposed outer and inner major surfaces with the air flow openings extending between the outer and inner major surfaces, the air flow regulator comprising first and second major opposed air flow regulator surfaces, the first air flow regulator surface being positioned adjacent to the inner major surface of the vent cover, wherein each coupler comprises a spring clip with at least two of said second coupler portions which are spaced apart from one another, and wherein said first coupler portion interconnects said at least two of said second coupler portions, said first coupler portion comprising an air flow regulator support portion which is coupled to the second air flow regulator surface to support the air flow regulator.

8. A vent assembly according to claim 7 wherein said first coupler portion comprises a duct retaining portion projecting away from the second air flow regulator surface.

9. A vent assembly according to claim 7 wherein said air flow regulator support portion is positioned parallel to the second air flow regulator surface.

10. A vent assembly according to claim 9 wherein the first coupler portion Jacks any portion which projects away from the second air flow regulator surface.

11. A vent assembly according to claim 7 wherein the vent cover comprises first and second vent cover side portions and a plurality of spaced apart vanes extending between the first and second vent cover side portions, the air flow openings comprising elongated air flow slots having sides bounded by respective vanes and ends bounded by respective portions of the first and second vent cover side portions, the second coupler portions having a first dimension in a first direction which is greater than the spacing between first and second of said vanes, the second coupler portions being oriented relative to the vent cover such that the second coupler portions are compressed in the first direction by the first and second vanes upon insertion of the second coupler portions into an air flow slot between the first and second vanes to thereby couple the air flow regulator to the vent cover.

12. A vent assembly according to claim 11 wherein the second coupler portions of each coupler are spaced apart a distance which is greater than the distance between the ends of the air flow slot such that the second coupler portions are compressed in a second direction toward one another by the respective portions of the first and second vent cover side portions which define the air flow slot when the second coupler portions are inserted into the air flow slot.

13. A vent assembly according to claim 11 wherein the vanes define slots at a first angle relative to the inner major surface of the vent cover, and wherein the second coupler portions and air flow regulator support portions are at a second angle from one another, the second angle being less than the first angle.

14. A vent assembly according to claim 11 wherein the second coupler portion comprises at least a portion of a loop of spring wire having a first dimension in the first direction.

15. A vent assembly according to claim 11 wherein the air flow regulator comprises plural guide slots through which the plural couplers extend with the first coupler portion of each coupler being on opposite sides of the air flow regulator from the second coupler portion of each coupler.

16. A vent assembly according to claim 15 wherein there are two of said couplers, one positioned adjacent a first end portion of the vent cover and another positioned adjacent a second end portion of the vent cover, wherein each of said couplers comprises only two of said second coupler portions and wherein there is a respective one of said guide slots adjacent to each of the second coupler portions.

17. A vent assembly according to claim 7 wherein the air flow regulator comprises plural guide openings through which the plural couplers extend with the first coupler portion and the at least two of said second coupler portion being on opposite sides of the air flow regulator from one another, the guide openings engaging the plural couplers to guide the sliding motion of the air flow regulator.

18. A vent assembly according to claim 2 comprising at least one actuator coupled to the air flow regulator and extending into one of the air flow openings for grasping by a user to slide the air flow regulator relative to the vent cover.

19. A vent assembly for controlling the flow of air through an opening, the vent assembly comprising:

a vent cover comprising a back surface and a front surface and a plurality of air flow openings through the vent cover from the front surface to the back surface;

an air flow regulator slidably coupled to the vent cover for sliding movement from a first closed position in which the air flow regulator substantially blocks the flow of air through the air flow openings to second open positions in which air is permitted to flow through the air flow openings; and an actuator coupled to the air flow regulator such that the actuator is movable relative to the air flow regulator and not pivoted by a pivot pin to the air flow regulator, and the actuator extending at least partially into at least a first of the air flow openings, the actuator being movable to a first actuator position to slide the air flow regulator to the first closed position and being movable to second actuator positions to slide the air flow regulator to the second open positions.

20. A vent assembly according to claim 19 in which the first of the air flow openings comprises elongated first air flow slot extending in a first direction, the air flow regulator being slidable in either direction along a path of travel which is skewed relative to the first direction, the actuator being slidable in either direction along the first air flow slot, the air flow regulator comprising an actuator guide slot extending in a second direction which is skewed relative to the first direction and relative to the path of travel, the actuator comprising a cam follower portion positioned in the actuator guide slot, whereby movement of the actuator in one direction along the first air flow slot slides the air flow regulator toward the closed position and movement of the actuator in another direction opposite to the one direction along the first air flow slot slides the air flow regulator toward the open positions.

21. A vent assembly according to claim 20 in which the vent cover has a longitudinal axis, the first direction being perpendicular to the longitudinal axis, the path of travel being parallel to the longitudinal axis, and wherein the second direction is at an acute angle relative to the first direction.

22. A vent assembly according to claim 21 in which the acute angle is thirty-five degrees.

23. A vent assembly for controlling the flow of air through an opening, the vent assembly comprising:

a vent cover comprising a back surface and a front surface and a plurality of air flow openings through the vent cover from the front surface to the back surface;

an air flow regulator slidably coupled to the vent cover for sliding movement from a first closed position in which the air flow regulator substantially blocks the flow of air through the air flow openings to second open positions in which air is permitted to flow through the air flow openings;

an actuator coupled to the air flow regulator and extending at least partially into at least a first of the air flow openings, the actuator being movable to a first actuator position to slide the air flow regulator to the first closed position and being movable to second actuator positions to slide the air flow regulator to the second open positions; and in which the actuator comprises a lever having a first portion coupled to the air flow regulator, a pivot portion positioned at least partially within the at least a first of the air flow openings and a grasping portion projecting from the pivot portion and generally away from the air flow regulator, wherein pivoting of the lever in a first direction slides the air flow regulator toward the closed position and pivoting the lever in the opposite direction slides the air flow regulator toward the open positions.

24. A vent assembly according to claim 23 in which the vent cover has an outer surface and an inner surface, wherein the lever is configured such that the pivot portion moves in a first direction toward the outer surface of the vent cover as the lever is pivoted in the opposite direction.

25. A vent assembly according to claim 23 in which the pivot portion is enlarged with curved outer surfaces positioned to engage and pivot against the portions of the vent cover defining the first of the air flow openings.

26. A vent assembly according to claim 24 in which the air flow regulator comprises a lever engaging portion having a lever receiving slot, the first lever portion having a distal end portion spaced from the pivot portion and comprising a tab with a shoulder sized such that the tab is insertable into the lever receiving slot with the shoulder engaging the slot, and wherein the first lever portion is bent between the shoulder and pivot portion.

27. A vent assembly according to claim 23 in which the first lever portion is not straight.

28. A vent assembly according to claim 19 wherein the vent cover is supported at an acute angle relative to horizontal when the vent assembly is installed.

29. A vent assembly according to claim 19 comprising vent cover supports having a first edge and which support the vent cover at an acute angle relative to horizontal.

30. A vent assembly according to claim 19 in which the vent cover is supported at an angle which is about forty-five degrees relative to horizontal when installed.

31. A building comprising plural vent assemblies of claim 19.

32. A building comprising plural vent assemblies of claim 28.

33. A vent cover assembly comprising:

vent cover means comprising plural openings;

air regulator means;

means for both frictionally engaging at least some of said plural openings and for slidably coupling the air regulator means to the vent cover means; and actuator means for sliding the air regulator means relative to the vent cover means from closed to open positions.

34. A vent assembly for controlling the flow of air through an opening, the vent assembly comprising:

a vent cover comprising a plurality of air flow openings;

an air flow regulator slidable relative to the vent cover from a first closed position in which the air flow regulator substantially blocks the flow of air through the air flow openings to second open positions in which air flow paths are provided through the air flow regulator and the air flow openings;

plural couplers slidably coupling the air flow regulator to the vent cover, each of said couplers comprising at least one first coupler portion coupled to the air flow regulator and at least one second coupler portion frictionally coupled to the vent cover;

the vent cover comprising plural coupler receiving openings, one of such coupler receiver openings being provided for each of said second coupler portions, the second coupler portions each comprising a compressible member sized so as to be compressed in at least one direction when inserted into a respective one of the coupler receiver openings, the compressible member engaging the vent cover within the coupler receiving opening to frictionally couple the air flow regulator to the vent cover;

the vent cover comprising opposed outer and inner major surfaces with the air flow openings extending between the outer and inner major surfaces, the air flow regulator comprising first and second major opposed air flow regulator surfaces, the first air flow regulator surface being positioned adjacent to the inner major surface of the vent cover, wherein each coupler comprises a spring clip with at least two of said second coupler portions which are spaced apart from one another, and wherein of each coupler, the first coupler portion of each coupler interconnects said at least two of said second coupler portions, said first coupler portion of each coupler comprising an air flow regulator support portion which is coupled to the second air flow regulator surface to support the air flow regulator;

wherein the vent cover comprises first and second vent cover side portions and a plurality of spaced apart vanes extending between the first and second vent cover side portions, the air flow openings comprising elongated slots having sides bounded by respective vanes and ends bounded by respective portions of the first and second vent cover side portions, the coupler portions having a first dimension in a first direction which is greater than the spacing between first and second vanes, the coupler portions being oriented relative to the vent cover such that the second coupler portions are compressed in the first direction by the vanes upon insertion of the second coupler portions of each coupler into an air flow slot;

the vanes defining air flow slots at a first angle relative to the inner major surface of the vent cover, and wherein the second coupler portions and air flow regulator support portions of each coupler extend at a second angle relative to one another, the second angle being less than the first angle;

the air flow regulator comprising plural guide openings through which the plural couplers extend with the first coupler portion and second coupler portions of each coupler being at opposite sides of the air flow regulator from one another, the guide openings engaging the couplers to guide the sliding motion of the air flow regulator; and an actuator coupled to the air flow regulator and extending at least partially into at least a first of the air flow openings, the actuator being movable to a first actuator position to slide the air flow regulator to the first closed position and being movable to second actuator positions to slide the air flow regulator to the second open positions.

35. A vent assembly according to claim 34 in which the actuator comprises a lever having a first end portion coupled to the air flow regulator, an enlarged pivot portion positioned at least partially within the at least a first of the air flow openings and a grasping portion projecting from the pivot portion and generally away from the air flow regulator, wherein pivoting of the lever portion in a first direction slides the air flow regulator toward the closed position and pivoting the lever in the opposite direction slides the air flow regulator toward the open positions, wherein the lever is configured such that the pivot portion moves in a first direction toward the outer surface of the vent cover as the lever is pivoted in the opposite direction.

36. A vent assembly according to claim 34 in which the vent cover is supported at an acute angle relative to horizontal when installed.

37. A vent assembly method comprising:

slidably coupling an air flow regulator to a vent cover for sliding between a plurality of open positions and a closed position; and wherein the act of coupling comprises frictionally engaging the vent cover at locations within plural openings defined by the vent cover with plural couplers with said couplers also engaging the air flow regulator to slidably couple the air flow regulator to the vent cover.

38. A method according to claim 37 in which the act of slidably coupling is accomplished solely by the plural couplers.

39. A vent assembly method comprising:

slidably coupling an air flow regulator to a vent cover for sliding between a plurality of open positions and a closed position;

wherein the act of coupling comprises frictionally engaging the vent cover with plural couplers with said couplers also engaging the air flow regulator to slidably couple the air flow regulator to the vent cover; and wherein the vent cover has front and back major surfaces, the method further comprising the act of pivoting an actuator about a pivot axis to slide the air flow regulator between the plurality of positions, and wherein the pivot axis shifts closer to the front surface upon sliding of the air flow regulator from the closed toward the open positions and shifts closer to the back surface upon sliding of the air flow regulator from an open position toward the closed position.

40. A vent assembly according to claim 1 wherein the vent cover is supported at an acute angle relative to horizontal when the vent assembly is installed.

41. A vent assembly according to claim 1 comprising vent cover supports having a first edge and which support the vent cover at an acute angle relative to horizontal.

42. A vent assembly according to claim 1 in which the vent cover is supported at an angle which is about forty-five degrees relative to horizontal when installed.

* * * * *

UNITED STATES PATENT AND TRADEMARK OFFICE

CERTIFICATE OF CORRECTION

PATENT NO. : 6,832,951 B2
DATED : December 21, 2004
INVENTOR(S) : Gary R. Orendorff It is certified that error appears in the above-identified patent and that said Letters Patent is hereby corrected as shown below:

Column 8,
Line 24, “T-0.057” should read -- T=0.057 --.

Column 13,
Line 33, “Jacks” should read -- lacks --.

Signed and Sealed this

Twenty-fourth Day of May, 2005

JON W. DUDAS
*Director of the United States Patent and Trademark Office*